US005857423A

United States Patent [19]

Imaeda et al.

[11] Patent Number: 5,857,423

[45] Date of Patent: Jan. 12, 1999

[54] SEAT ARRANGEMENT FOR A WATERCRAFT

[75] Inventors: Hirofumi Imaeda; Hideaki Fukamura, both of Iwata, Japan

[73] Assignee: Yamaha Hatsudoki Kabushiki Kaisha, Iwata, Japan

[21] Appl. No.: 723,499

[22] Filed: Sep. 30, 1996

[30] Foreign Application Priority Data

Dec. 26, 1995 [JP] Japan ..... 7-339469

[51] Int. Cl.[6] ..... B63B 35/00

[52] U.S. Cl. ..... 114/270; 114/363

[58] Field of Search ..... 440/38, 46, 47; 114/343, 361, 363, 364, 270

[56] References Cited

U.S. PATENT DOCUMENTS 5,522,742 6/1996 Futaki et al. ..... 440/46

FOREIGN PATENT DOCUMENTS 404123996 4/1992 Japan ..... 440/46

OTHER PUBLICATIONS

Cobia, Cobia Boat Company, Vonore, TN, brochure, Oct. 1993.

Larson, Larson Boats, Little Falls, Minnesota, brochure, Oct. 1994.

*Primary Examiner*—Stephen Avila

*Attorney, Agent, or Firm*—Knobbe, Martens, Olson & Bear LLP

[57] ABSTRACT

A watercraft having a bow rider-type configuration wherein the forwardmost riders' seats are canted slightly inwardly toward the longitudinal centerline of the watercraft so as to permit adequate leg room without overly extending the length of the hull. A pass-through connects the bow riders' portion to a main seating portion in which a bench-type seat that is adapted to accommodate three riders is provided. The pass-through between the seating portions is not significantly wider than one of the seats. Various arrangements for a storage compartment and engine and jet pump clean-out and flushing access are also provided.

37 Claims, 8 Drawing Sheets

SEAT ARRANGEMENT FOR A WATERCRAFT

BACKGROUND OF THE INVENTION

This invention relates to a watercraft and more particularly to an improved seat arrangement, passenger compartment, storage and service access arrangement for a watercraft.

The design of watercraft and particularly the passenger's area thereof presents considerable challenges to the designer, particularly in the class of watercraft that is designed primarily to a accommodate a relatively few (for example, less than 8 passengers). The watercraft should be designed so as to provide comfortable seating area for each passenger. In addition, the passenger should be seated in positions wherein each of them can enjoy the view with obstructions from the others. In addition to this, there must be some provision provided in the watercraft for carrying paraphernalia used by boaters such as coolers, beverages, food, water skiing equipment and other such devices.

Of course, these requirements can be met by merely making the size of the watercraft larger. However, as the size of the watercraft is increased, then the power requirements in order to drive it are also increased. This adds to the cost of the assembly and further makes it difficult to trailer the watercraft from one location to another.

It is, therefore, a principal object to this invention to provide an improved watercraft and passenger's compartment therefore.

It is a further object of this invention to provide an improved watercraft passenger's area wherein each rider can be comfortably seated.

One type of watercraft which is becoming relatively popular is the so-called "bow rider" type of watercraft. With this type of watercraft there is a main passenger's compartment positioned at approximately mid-ships and wherein the operator's control position is located. The bow of the watercraft is provided with a further passenger's area and frequently a pass-through is provided between the main passenger's area and the bow area.

For convenient and efficient hull configuration, however, the bow area generally tapers inwardly toward the tip or nose of the bow. Thus, the foot area for passengers seated in the bow area can be restricted.

It is, therefore, a still further object of this invention to provide an improved seating area for utilization in a peripheral edge of the watercraft where the watercraft tapers to a point and which will still offer adequate leg room for the passengers.

As should be apparent from the foregoing description, with this type of watercraft it is also desirable to permit access between the two rider's areas without the rider having to climb over the portion of the hull which separates the two areas. Pass-throughs can be provided but these pass-throughs then restrict the available seating area in the bow portion as well as its effectiveness.

It is, therefore, a still further object of this invention to provide an improved passenger's compartment arrangement for a bow rider type of watercraft.

As has been previously noted, it is also desirable to provide storage and other areas in the hull where paraphernalia utilized by the riders can be stored. However, these areas should also offer free and easy access.

It is, therefore, a still further object of this invention to provide an improved storage arrangement for a watercraft of this general type wherein the storage area can be easily accessed.

In addition to having storage areas, there is also the problem of positioning the propulsion system for the watercraft. Although outboard motor arrangements can be utilized and do provide a greater facility for storage areas, there are a number of disadvantages to such arrangements. Furthermore, an inboard propulsion system offers a much neater appearing watercraft and in some regards provides one which will handle and can be controlled better. However, there is then provided the problem of being able to access the propulsion unit for servicing.

It is, therefore, a still further object of this invention to provide an improved storage and access arrangement for a watercraft.

It is a further object of this invention to provide an improved jet propelled watercraft having a convenient arrangement for accessing the propulsion unit for servicing without necessitating removal of the watercraft from the body of water in which the watercraft operates.

In connection with the servicing of the engine, it is frequently desirable to provide an arrangement for flushing the cooling system of the engine. This is done when the watercraft is not in use and is done primarily for the purpose of purging salt water from the engine cooling system. In many instances, the water for the engine cooling system is circulated by diverting a portion of the water pumped by a jet propulsion unit for the watercraft through the engine cooling system. Although purging systems may be provided for purging the engine cooling jacket, there is not a convenient arrangement normally provided that would permit also the jet propulsion unit to be purged of salt water.

It is, therefore, a still further object of this invention to provide an improved purging system for a jet propelled watercraft propelled by a water-cooled engine wherein both the jet propulsion unit and the engine cooling jacket may be purged through the same flushing source.

SUMMARY OF THE INVENTION

A first feature of this invention is adapted to be embodied in a watercraft that is comprised of a hull that defines a passenger's area at a peripheral area thereof. The hull tapers inwardly in the area surrounding the passenger's area so that the passenger's area tapers toward a line extending through the peripheral edge. A pair of seats are positioned in the passenger's area and are disposed at an angle toward the line so that occupants seated in the seats will have their legs converging toward the line in the direction toward the outer peripheral edge of the hull.

Another feature of the invention is adapted to be embodied in a watercraft that is comprised of a hull having a forwardly tapering bow in top plan view with a substantially wider rear hull area. A passenger's area is formed in an upper area of the hull and is comprised of a first portion that extends transversely thereacross and which contains a bench-type seat that is sized to accommodate at least three adult passengers seated in sideby-side fashion. The passenger's area further comprises a second, bow portion formed at the bow portion of the hull and containing a pair of spaced-apart forward seats each of which is adapted to accommodate at least one adult passenger. A pass-through joins the first and second portions and extends in the area between the forward seats. This pass-through has a width that is approximately equal to the width of the center portion of the bench-type seat so as to afford full seating access for all seated passengers.

Another feature of the invention is also adapted to be embodied in a watercraft that is comprised of a hull. The hull defines a passenger's area in an upper portion thereof. At least one seat is formed in the passenger's area at a peripheral portion thereof. The seat comprises a bottom portion that is adapted to support a seated rider and a backrest portion. The backrest portion is formed with a first vertically extending part against which the seated rider can place his back and a connected horizontally extending portion that forms at least a part of an upper surface of the hull. The seat backrest portion is pivotally connected at a peripheral edge of its horizontally extending portion to the remainder of the hull for movement between a closed position and an open position wherein an interior area of the hull is accessible.

A still further feature of the invention is adapted to be embodied in a watercraft that is comprised of a hull powered by a pair of jet propulsion units that are disposed in side-by-side relationship. The hull undersurface receives at least in part the jet propulsion units. The upper portion of the hull overlying the jet propulsion units and forming the exterior of this hull is spaced a distance from the outer housings of the jet propulsion unit. Access openings are formed in this upper hull portion and are connected by means of flexible couplings to clean out openings formed on the respective jet propulsion units so that the jet propulsion units may be cleared of foreign matter.

Yet another feature of the invention is adapted to be embodied in a watercraft having a hull containing a water cooled, powering internal combustion engine and which drives a jet propulsion unit for propelling the hull. The jet propulsion unit includes means for diverting a portion of the water pumped thereby to the engine cooling jacket for cooling of the engine. At least this conduit and a portion of the jet propulsion unit are also contained within the hull. A flushing conduit intersects the conduit that interconnects the jet propulsion unit to the engine cooling jacket and has an end that is accessible and which is adapted to be detachably connected to a hose for flushing both the jet propulsion unit and the engine cooling jacket.

DETAILED DESCRIPTION OF THE PREFERRED EMBODIMENTS OF THE INVENTION

Figure 1:
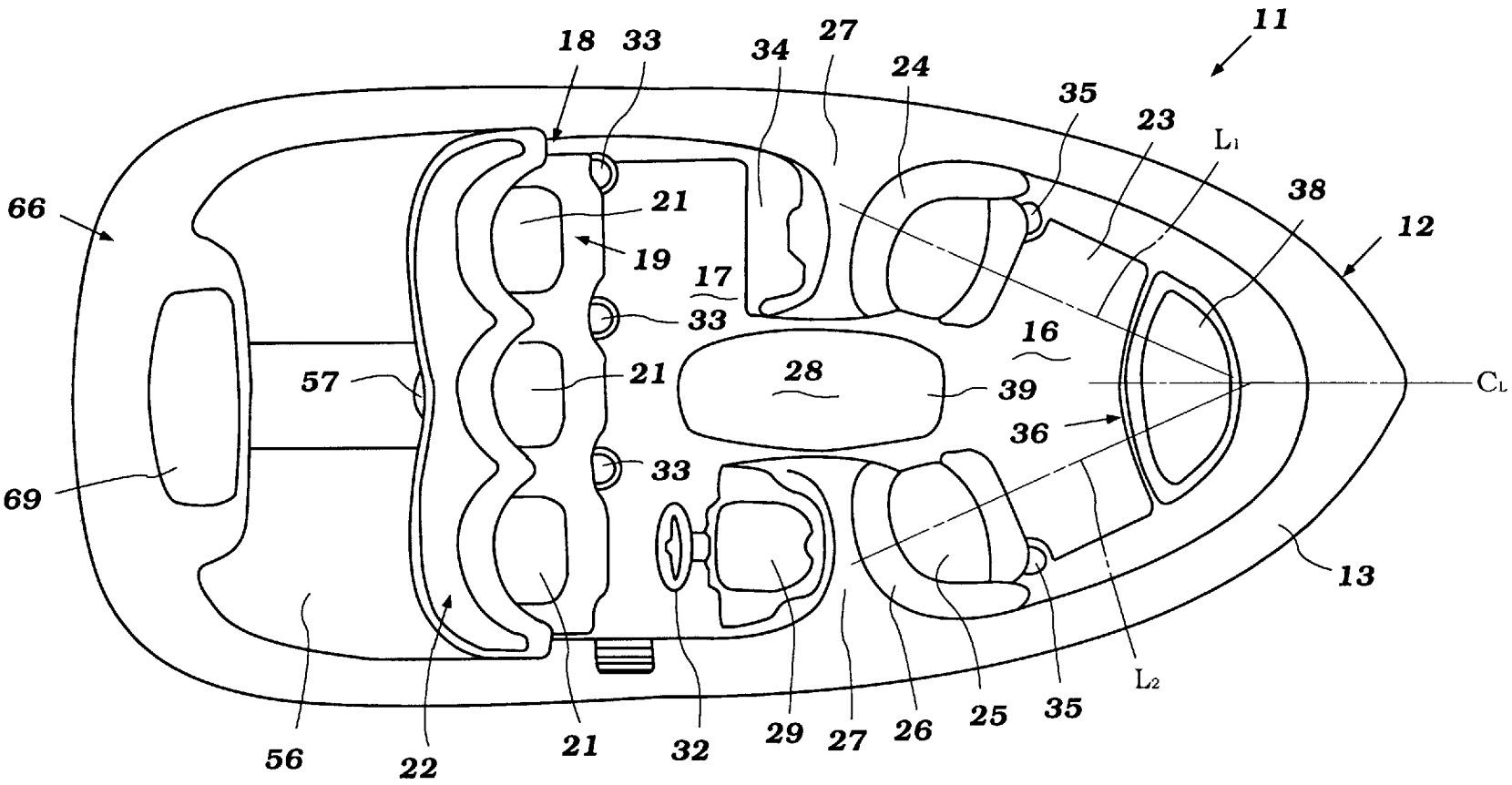
FIG. 1 is a top plan view of a watercraft constructed in accordance with an embodiment of the invention.
Figure 2:
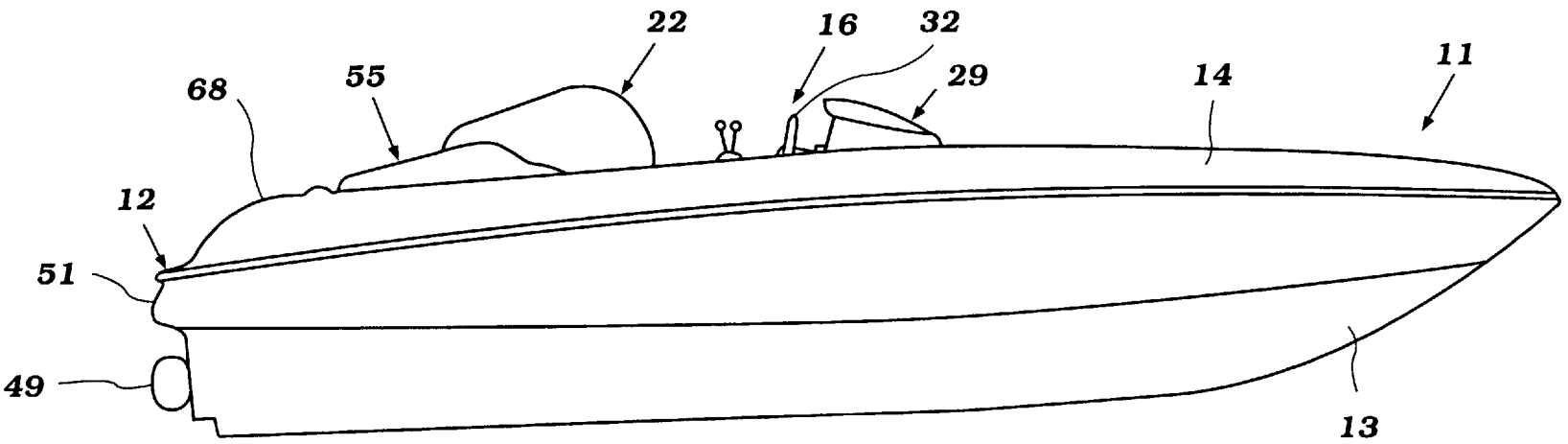
FIG. 2 is a side elevational view of the watercraft.

Referring now in detail to the drawings and initially primarily to FIGS. 1 and 2, a watercraft constructed in accordance with an embodiment of the invention is illustrated and is identified generally by the reference numeral 11. The watercraft 11 is comprised primarily of a hull, indicated generally by the reference numeral 12. The hull 12 is comprised of a hull underportion 13 and hull deck portion 14. The underportion 13 and deck portion 14 are both formed from a suitable material such as a molded fiberglass reinforced resin or the like. A passenger's area, indicated generally by the reference numeral 16 is formed primarily by the deck portion 14.

This passenger's area 16 is comprised of a first centrally positioned passenger's area in which a bench-type seat, indicated generally by the reference numeral 18 is provided. This bench-type seat 18 is comprised of a removable cushion portion 19 which defines three bench-type seat parts 21 each of which is sized and adapted to accommodate a single adult passenger. A seat back assembly 22, cooperates with the seat cushions 21 in a manner which will be described.

Continuing to refer to the rider's area 16, it includes a forward or bow rider's portion indicated generally by the reference numeral 23 and which has a generally triangular configuration in top plan view. This configuration matches the general configuration of the hull 12 in top plan view as seen in FIG. 1.

The forward passenger's area portion 23 is provided with a pair of passenger seats 24 and 25 each sized to accommodate an adult passenger. These seat portions 24 and 25 include respective backrests 26. It should seen that the seat portions 24 and 25 are disposed so that riders seated thereon will extend along a general line of seating indicated by the respective lines $L_1$ and $L_2$. The lines $L_1$ and $L_2$ intersect a longitudinal center line CL of the watercraft. Because of this angular relationship for the passenger seats 24 and 25, the passengers may be seated comfortably and stretch their legs forwardly so as to have adequate leg room without interference.

The seat backs 26 are formed by portions of the deck 13 indicated by the reference numerals 27 and which extend inwardly toward the hull center line CL and which define a passageway 28 through which a rider may pass between the forward seating portion 23 and the main seating portion 17. The width of the passageway 28 is substantially equal to or smaller than the width of one of the seat portions 21. This is done so as to provide adequate body strength, maximum seating capacity for the riders in the seats 24 and 25 and still free access.

Figure 3:
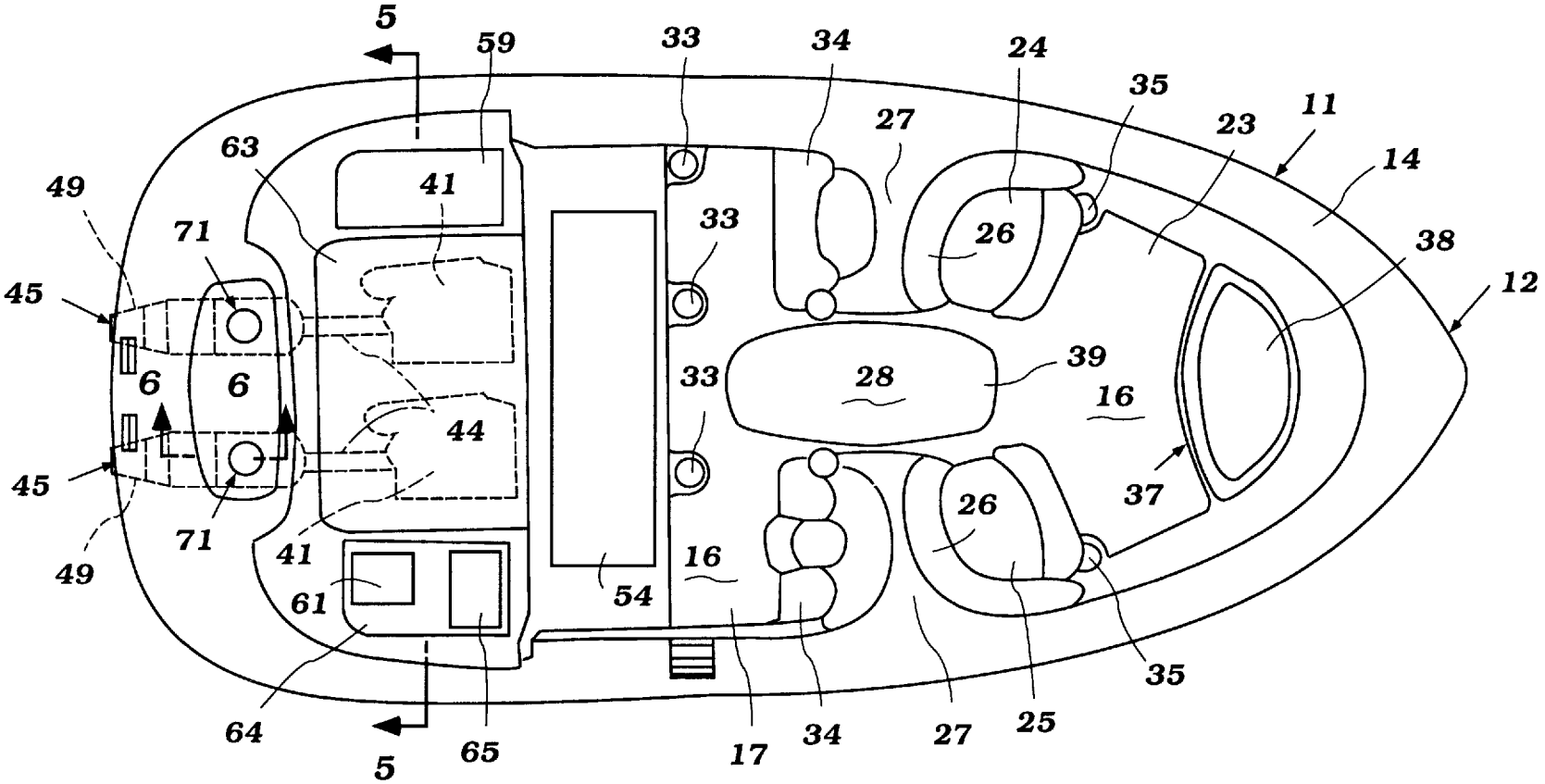
FIG. 3 is a top plan view, in part similar to FIG. 1, but shows certain components removed and other components in cross-section to more clearly indicate the construction.
Figure 4:
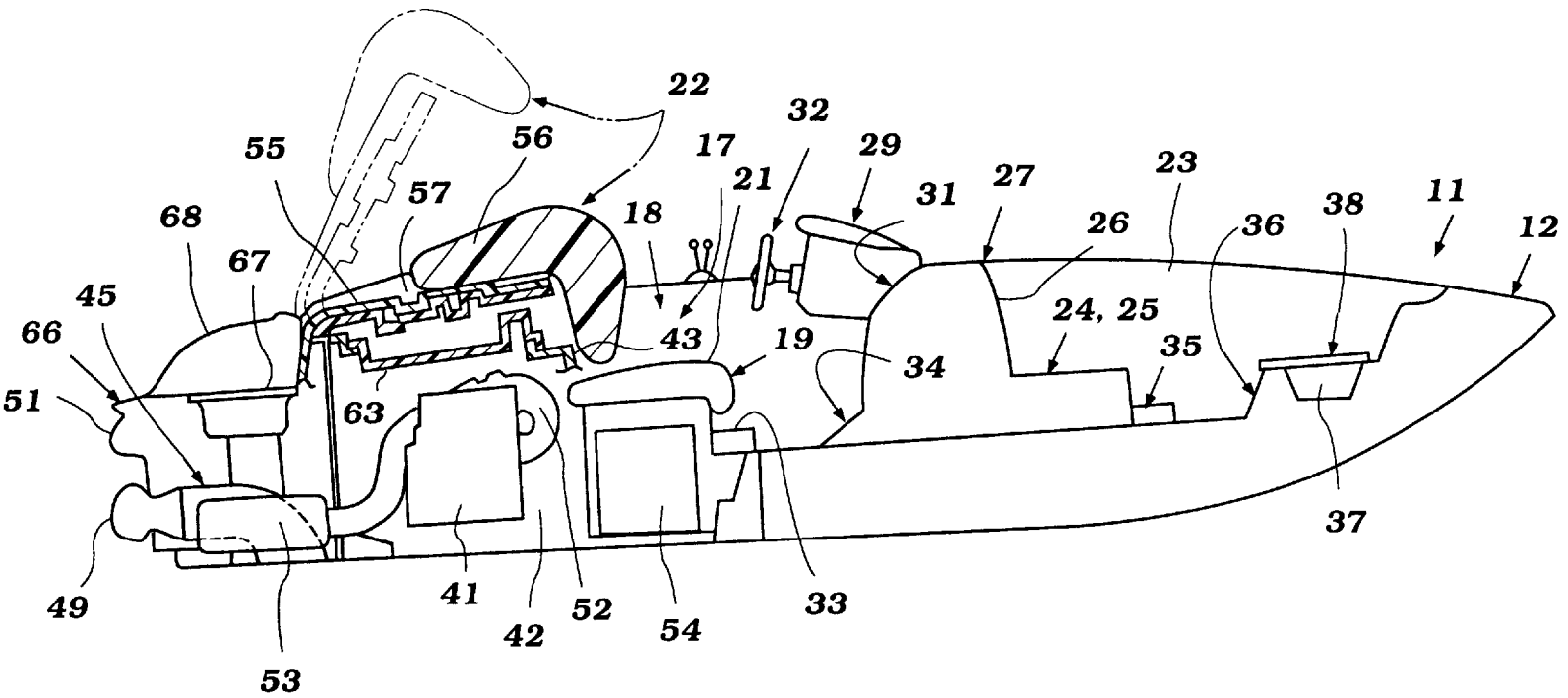
FIG. 4 is a side elevational view, in part similar to FIG. 2, but showing a cross-sectional type view with the outer hull being shown in outline and with other portions broken away and shown in section including a showing of the access for the engine compartment by illustrating the main seat back in its normal position in solid lines and in its access position in phantom lines.

Continuing to refer to the passenger's area 16 and referring now additionally to FIGS. 3 and 4, it will be seen that the right-hand side of the main passenger's area 17 is formed with a control panel 29 that is mounted on a panel surface 31 formed at the rear of the right-hand hull portion 27. Numerous instruments and controls may be mounted on the control panel 29 including a steering wheel 32 by steering of the watercraft in a manner which will be described.

Individual cup holders 33 may be provided in the floor area adjacent each of the seat portions 21. A toe area 34 is provided at this side of the raised portion 27 and a like toe area 34 is provided at the opposite side so that the riders seated in the side seats 21 of the bench-type seat 18 will have an area to brace their feet. The passenger seated in the center seat 22 may extend his feet forwardly into the pass-through area 28.

Like the rear seating area, a pair of cup holders 35 are provided at the base of each of the front seats 24 and 25 so as to accommodate cups or drinking vessels for the watercraft passengers.

At the front of the front passenger's area 23 there is provided a raised pedestal 36 which has a storage compartment 37 that can be utilized for a variety of purposes, such as functioning as a picnic cooler. This compartment 37 may be configured so that it can be lifted out for use at a remote location. A cover plate 38 encloses this storage compartment 37. The cover plate 38 may form a raised area on which the riders in the seats 24 and 25 may place their fee. Alternatively, a still further passenger may sit on the cover plate 38. This central passenger can sit in a rearwardly facing direction and extend his legs into the pass-through area 28 thus, leaving free leg area for three adult passengers in the front seat area 23.

The area beneath the pass-through 28 in the hull 12 is provided with an elongated storage compartment which does not appear in the figures but which has a construction which should be obvious to those skilled in the art. A hatch cover 39 is provided over this storage area. Elongated objects such as fishing poles, water skis or the like may be conveniently concealed beneath this area.

The propulsion system for the watercraft 11 will now be described by primary reference to FIGS. 3 through 5. In the illustrated embodiment, there are provided a pair of dual propulsion units. Each propulsion unit is comprised of an internal combustion engine 41 which engines are disposed in an engine compartment 42 formed to the rear of the main passenger compartment 17 and separated therefrom by a bulkhead 43. The engines 41 may be of any known type and, in the illustrated embodiment, comprise, for example, three-cylinder in-line two-cycle internal combustion engines. Although such an engine is described, it will be readily apparent to those skilled in the art that the invention may be practiced with a wide variety of types of engines normally used in watercraft.

The engines 41 have drive shafts that extend rearwardly and each of which is connected to a respective impeller shaft 44 (FIG. 6) of a respective jet propulsion unit, indicated generally by the reference numeral 45. Each jet propulsion unit 45 includes a water inlet opening portion 46 which may be formed either in the body of the hull underportion 13 or as a unit with the remainder of the jet propulsion unit. Each water inlet portion 46 defines a downwardly facing water inlet opening 47 that opens through the lower surface of the hull portion 13 and through which water is drawn in a well-known manner.

Each jet propulsion unit 45 includes an impeller, which is not shown but which is contained within a main housing portion 48 that is disposed to the rear of the water inlet passage 46. This impeller is coupled to the impeller shaft 44 for pumping the water and delivering it rearwardly to a discharge nozzle portion 49 for rearward discharge. As is typical with jet propulsion systems for watercraft, the discharge nozzles 49 may be supported for steering movement about a respective vertically extending axis. These discharge nozzle portions 49 are coupled to the steering wheel 32 in a well-known manner for steering of the watercraft.

The discharge nozzles 49 are disposed slightly forwardly of and beneath a transom 51 of the watercraft hull. The engines 41 are provided with an exhaust system which includes an exhaust manifold and expansion chamber device 52 which collects the exhaust gases from the exhaust ports of the engine and delivers them to a water trap device 53 that is positioned at the rear of the hull and which discharges the exhaust gases to the atmosphere in any well-known manner.

As may be best seen in FIGS. 3 and 4 and as has been noted, the seat portion 19 of the main bench-type passenger seat 18 is removable. A storage compartment is formed therebeneath in which a fuel tank 54 for supplying fuel to the engines 41 may be positioned. The fuel tank 54 is provided with an appropriately located fill tank fill nozzle closed by a cap.

The engine compartment 42 is provided in an area that is disposed and covered by a horizontally extending member 55 which may be formed from a molded fiberglass reinforced resin or the like, and which carries the seat back 22. That is, the seat back 22 is affixed to the portion 55 so that the seat back 22 is comprised of a vertically extending portion upon which the seated passengers may place their back and a rearwardly extending cushioned portion 56 which forms an extension of this backrest, and the horizontally extending portion 55.

This portion 55 is pivotally connected by a pair of spaced-apart hinges to the hull deck portion 12 so as to be movable between a closed position, as shown in most figures and in the solid line view of FIG. 4, and an open position, as shown in the phantom line view of this figure. A grab-hole recess 57 is formed adjacent the rear of the seat cushion portion 56 so as to facilitate this movement.

Figure 5:
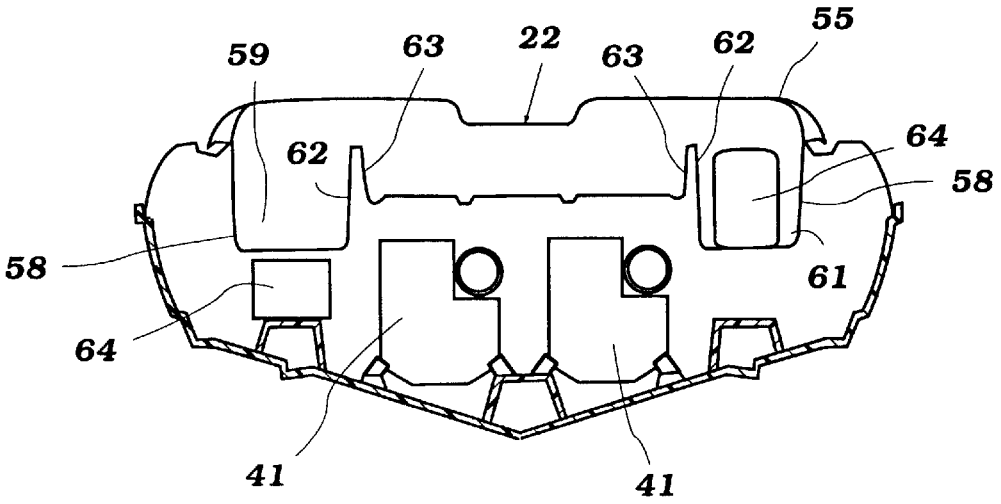
FIG. 5 is a cross-sectional view taken along the line 5—5 of FIG. 3.

Opening of this cover formed by the seat back 22 affords access to a storage area that is best seen in FIG. 5, with FIG. 4 also showing this storage compartment with the seat back removed so as to more clearly show the storage compartment portions. It will be seen that this storage compartment is provided by a depressed area of the deck portion 14 that comprises a pair of downwardly extending depressions 58 which form side storage compartments 59 and 61, respectively. Upstanding walls 62 define the inner perimeter of the storage compartments 59 and 61, and terminate in lips on which a removable storage compartment-forming member 63 is provided. This portion 63 may be easily lifted out so as to provide access to the engines 41 for servicing. It should be noted that when the seat back portion 22 is pivoted up, the engines 41 may be easily accessed by persons kneeling on the seat cushions 21.

The compartment 61 may contain accessories for the engine that require more frequent access, such as a battery 64 or an oil tank 65. A further battery 64 is positioned beneath the container area 59.

Figure 6:
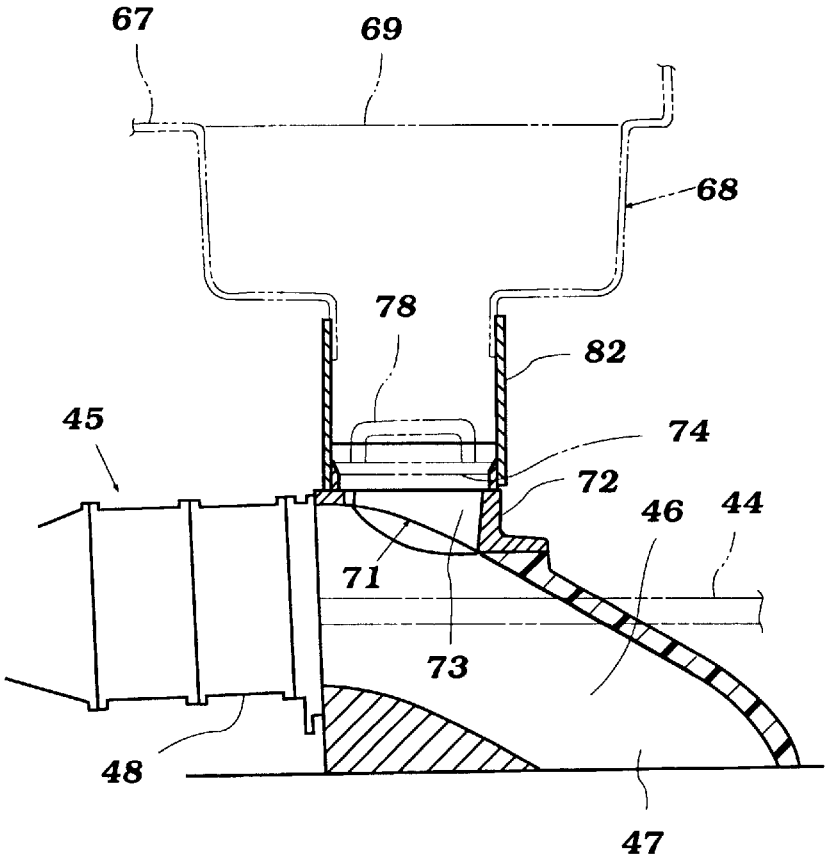
FIG. 6 is an enlarged cross-sectional view taken along the line 6—6 of FIG. 3.
Figure 7:
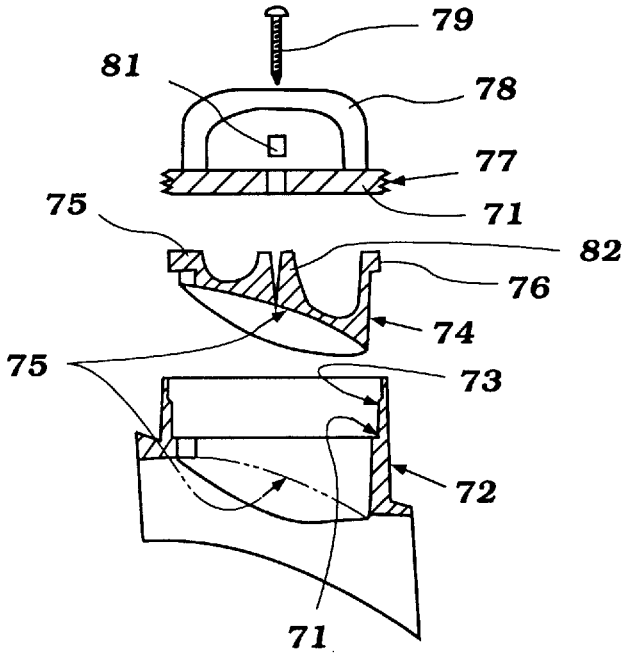
FIG. 7 is a further enlarged exploded view showing the access opening related closure for clean out of one of the jet propulsion units.

The area to the rear of the seat back 22, and specifically the deck-forming portion 55 thereof, provides a rear deck, indicated generally by the reference numeral 66, and which includes a floor portion 67 and a pair of raised side portions 68. The portion 67 lies over the jet propulsion units 45, and specifically the water inlet portions 46 therefor, as best seen in FIG. 6. This is to afford access to the inlet portions 46 of the jet propulsion units 45 for cleaning purposes, as will now be described.

Each clean-out mechanism includes a generally funnel-shaped member 68 which may be formed integrally with the deck portion 67 and which is closed at its upper end by a closure plate 69. When the closure plate 69 is removed, it offers access to a clean-out opening 71 formed in the upper portion of each jet propulsion unit water inlet opening 46. These openings 71 are formed by members 72 which in turn have internal openings 73. The internal openings 73 are removably closed by clean-out plugs, indicated generally by the reference numeral 74. These clean-out plugs 74 include members having surfaces 75 that are complementary to and form extensions of the water inlet passage 46. A flanged upper portion 76 thereof has attached to it a closure plug via a threaded connection 77 which cooperates with internal threads in the opening 71. A handle 78 is affixed to the closure plug 74 by a screw 79 and grommet 81 received in an upwardly extending portion 82 of the closure plug 74 so as to easily screw the closure plug 74 into and out of position. A pair of elastic sleeves 82 interconnect the upper ends of these clean-out members 72 with the hull portion 68 so as to provide a neat and easily accessed arrangement for removing and cleaning of the jet propulsion unit water inlets 46.

Figure 8:
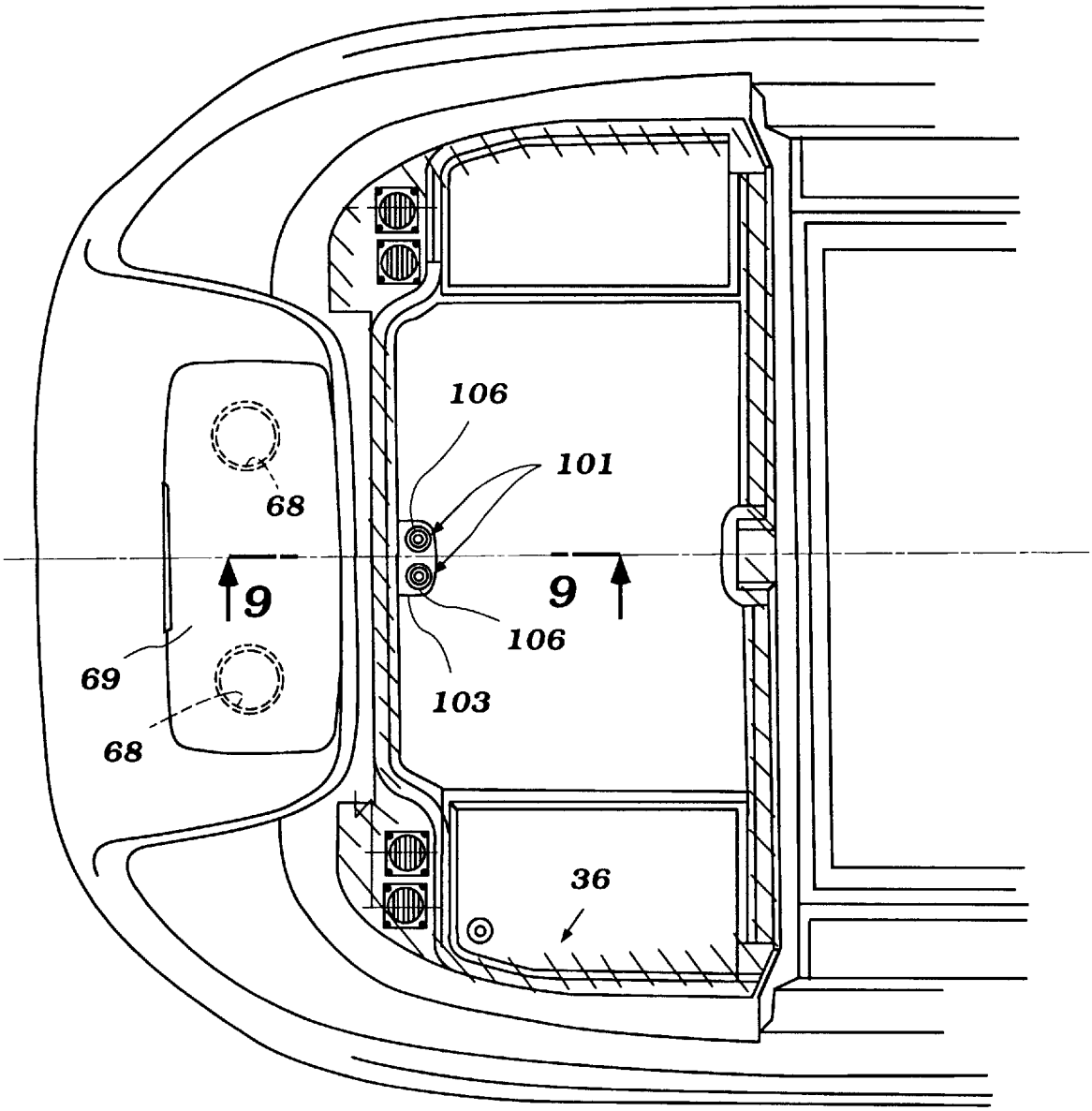
FIG. 8 is a top plan view of a watercraft constructed in accordance with yet another embodiment of the invention.
Figure 9:
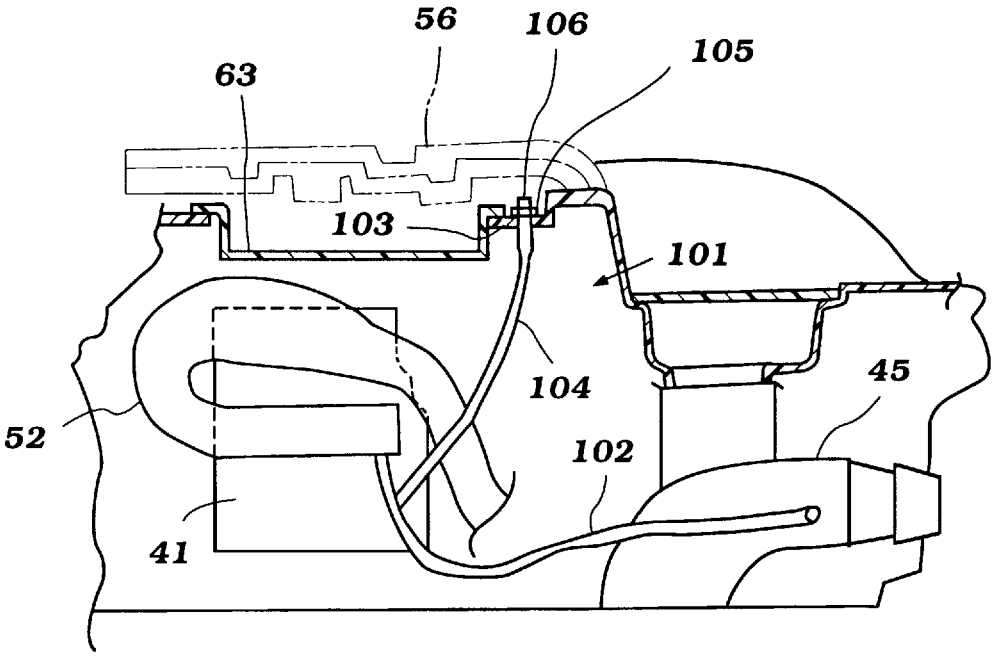
FIG. 9 is a cross-sectional view taken along the line 9—9 of FIG. 8.

FIGS. 8 and 9 show another embodiment of the invention which can be employed with the previously-described embodiment. In this embodiment, however, the seat back assembly 22 is formed as a separate member from the horizontally-extending portion 56. Thus, in this embodiment, the cowling hatch portion, again indicated by the reference numeral 56 is pivotally connected to the hull at its forward rather than its rearward end. This is done to provide access to a pair of flushing mechanisms, indicated generally by the reference numeral 101 each of which cooperates with a respective one of the jet propulsion units 45 and the cooling jackets of the engines 41. The cooling jacket of each engine is supplied with cooling water that is drawn from the body of water in which the watercraft 11 is operating and which is pumped by the impeller of the associated jet propulsion unit 45.

A small amount of this water is delivered through a coolant conduit 102 that extends to the exhaust manifold and expansion chamber devices 52 of the engine 41. This mechanism is water jacketed and the cooling water flows first through it and then through the cooling jacket of the engine 41. Of course, various flow arrangements may be provided. Also, and as is well-known in the art, this cooling water is then dumped back into the body of water in which the watercraft is operating in a suitable manner. This may be done via the exhaust system, as is well known in this art.

In order to flush both these cooling jackets of the engine 41 and also to flush the jet propulsion unit 45 if the watercraft is removed from the body of water in which it is operating, the flushing mechanisms 101 are employed. There is provided one flushing mechanism for each propulsion system although a single inlet may be used to flush both units.

The portion of the deck surrounding the opening closed by the removable storage compartment 63 is provided with an extending flange 103 to which fitting ends of conduits 104 are affixed by a fastener 105. The fitting ends are indicated by the reference numeral 106 and they can comprise either male or female threaded fittings that are closed by suitable closure plugs and which may be connected when opened to a common garden hose so that fresh water can be flushed through the cooling jackets of the engine 41 and its exhaust system 52 and also through the jet propulsion unit 45 if the watercraft 11 is removed from the body of water in which it is operating. In this way, it will be possible to flush any salt water which may be in these components if the watercraft 11 was operated in a marine saltwater environment.

It should be noted that this flushing attachment may also be employed, as previously mentioned, in connection with the watercraft of the embodiment of FIGS. 1–7. In that event, the fittings should be placed closer to the seat back 22 for easier access due to the rearward pivotable support of the hatch cover 55 and the seat back portion 22 in that embodiment.

Thus, from the foregoing description, it should be readily apparent that the described watercraft embodiments provide a very effective and highly usable seating area, and a watercraft in which the components can be easily accessed for servicing, and which provides a large storage capacity. Of course, the foregoing description is that of preferred embodiments of the invention, and various changes and modifications may be made without departing from the spirit and scope of the invention, as defined by the appended claims.

What is claimed is:

1. A watercraft and seating arrangement therefor, said watercraft comprising a hull defining a passengers' area at a peripheral portion thereof, said hull tapering inwardly in the area surrounding said passengers' area so that the sides of said passengers' area taper toward a line terminating at the peripheral edge of said hull, and a pair of seats positioned in said passengers' area each of said seats having a back rest portion and a cushion portion disposed at an angle toward said lines said back rest portions extending generally perpendicular to said passengers' area sides so that passengers sitting normally in said seats will have their legs converging toward said line.

2. A watercraft and seating arrangement as set forth in claim 1, wherein the passenger's area is formed at the bow of the hull.

3. A watercraft and seating arrangement as set forth in claim 1, further including a storage area formed in the passenger's area at the peripheral edge of the hull.

4. A watercraft and seating arrangement as set forth in claim 3, wherein the storage area is formed beneath a raised portion in the floor of the hull so that the raised portion forms a further seat for a passenger facing in the opposite direction from passengers seated in the pair of seats with the third passenger's legs extending between the cushion portions of said pair of seats.

5. A watercraft and seating arrangement as set forth in claim 4, wherein the passenger's area is formed at the bow of the hull.

6. A watercraft comprised of a hull having a forwardly tapering bow in top plan view with a substantially wider rear hull area, a passengers' area formed in the upper area of said hull comprising a first portion extending transversely thereacross, and containing a bench-type seat sized to accommodate at least three adult passengers seated in side-by-side fashion, said passengers' area further comprising a second, forward portion formed at the bow of said hull and comprising a pair of spaced-apart passenger seats, each adapted to accommodate at least one adult passenger, and a pass-through portion formed in said hull by a pair of inwardly extending portions that extend into the passenger's area from the sides of said hull for connecting said first and said second passenger area portions with a common floor extending therebetween for passage between said second portion and said first portion, said pass-through area being no greater than substantially the same width as one of the seats.

7. A watercraft as set forth in claim 6, further including a control for a watercraft propulsion system formed on one side of the passenger portion by the respective inwardly extending portion of the hull and disposed forwardly of a side of the bench-type seat.

8. A watercraft as set forth in claim 6, further including a propulsion unit for the watercraft disposed to the rear of the passenger's area, said propulsion unit comprising an internal combustion engine and a propulsion device driven by said engine.

9. A watercraft as set forth in claim 8, wherein the propulsion device comprises a jet pump.

10. A watercraft as set forth in claim 9, wherein there are provided a pair of propulsion devices behind the passenger's compartment for propelling the watercraft.

11. A watercraft comprised of a hull having a forwardly tapering bow in top plan view with a substantially wider rear hull area, a passengers' area formed in the upper area of said hull comprising a first portion extending transversely thereacross, and containing a bench-type seat sized to accommodate at least three adult passengers seated in side-by-side fashion, said passengers' area further comprising a second, forward portion formed at the bow of said hull and comprising a pair of spaced-apart passenger seats, each adapted to accommodate at least one adult passenger, and a pass-through portion formed in said hull by a pair of inwardly extending portions that extend into the passenger's area from the sides of said hull for connecting said first and said second passenger area portions with a common floor extending therebetween for passage between said second portion and said first portion, said pass-through area being no greater than substantially the same width as one of the seats, each of said pair of inwardly extending portions forming a foot rest for a rider seated in a respective side of the bench-type seat.

12. A watercraft as set forth in claim 11, further including a control for a watercraft propulsion system formed on one side of the passenger portion by the respective inwardly extending portion of the hull and disposed forwardly of a side of the bench-type seat.

13. A watercraft comprised of a hull having a forwardly tapering bow in top plan view with a substantially wider rear hull area, a passengers' area formed in the upper area of said hull comprising a first portion extending transversely thereacross, and containing a bench-type seat sized to accommodate at least three adult passengers seated in side-by-side fashion said passengers' area further comprising a second, forward portion formed at the bow of said hull and comprising a pair of spaced-apart passenger seats, each adapted to accommodate at least one adult passenger, and a pass-through portion formed in said hull by a pair of inwardly extending portions that extend into the passenger's area from the sides of said hull for connecting said first and said second passenger area portions with a common floor extending therebetween for passage between said second portion and said first portion, said pass-through area being no greater than substantially the same width as one of the seats, a propulsion unit for the watercraft disposed to the rear of the passenger's area, said propulsion unit comprising an internal combustion engine and a jet propulsion device driven by said engine a selectively openable cover disposed above the propulsion unit for accessing the propulsion unit.

14. A watercraft as set forth in claim 13, wherein the cover is pivotably connected to the hull.

15. A watercraft as set forth in claim 14, wherein the cover further forms a back rest for the bench-type seat.

16. A watercraft as set forth in claim 13, further including a storage area formed beneath the cover.

17. A watercraft as set forth in claim 16, wherein the storage area includes a removable portion that normally closes an access opening over the propulsion unit.

18. A watercraft as set forth in claim 13, further including a propulsion unit for the watercraft disposed to the rear of the passenger's area, said propulsion unit comprising an internal combustion engine and a jet pump driven by said engine for propelling the hull.

19. A watercraft comprised of a hull having a forwardly tapering bow in top plan view with a substantially wider rear hull area, a passengers' area formed in the upper area of said hull comprising a first portion extending transversely thereacross and containing a bench-type seat sized to accommodate at least three adult passengers seated in side-by-side fashion, said passengers' area further comprising a second, forward portion formed at the bow of said hull and comprising a pair of spaced-apart passenger seats, each adapted to accommodate at least one adult passenger, a pass-through portion formed in said hull for connecting said first and said second passenger area portions with a common floor extending therethrough for passage between said second portion and said first portion, said pass-through area being no greater than substantially the same width as one of the seats, a propulsion unit for said watercraft disposed to the rear of said passenger's area, said propulsion unit comprising an internal combustion engine and a propulsion device driven by said engine, a selectively openable cover disposed above said propulsion unit for accessing the propulsion unit, and a hose connection disposed immediately beneath said cover for connection to a hose for flushing the propulsion unit with fresh water.

20. A watercraft as set forth in claim 19, wherein the propulsion unit comprises a water-cooled internal combustion engine and a jet pump and the flushing device flushes both the engine cooling jacket and the interior of the jet pump.

21. A watercraft as set forth in claim 20, wherein there are provided a pair of propulsion devices behind the passenger's compartment for propelling the watercraft.

22. A watercraft comprised of a hull having a forwardly tapering bow in top plan view with a substantially wider rear hull area, a passengers' area formed in the upper area of said hull comprising a first portion extending transversely thereacross and containing a bench-type seat sized to accommodate at least three adult passengers seated in side-by-side fashion, said passengers' area further comprising a second, forward portion formed at the bow of said hull and comprising a pair of spaced-apart passenger seats, each adapted to accommodate at least one adult passenger, a pass-through portion formed in said hull for connecting said first and said second passenger area portions with a common floor extending therethrough for passage between said second portion and said first portion, said pass-through area being no greater than substantially the same width as one of the seats, a propulsion unit for said watercraft disposed to the rear of said passenger's area, said propulsion unit comprising an internal combustion engine and a jet pump driven by said engine, a selectively openable cover disposed above said propulsion unit for accessing the propulsion unit, and a removable portion in an upper portion of said jet pump for accessing a water inlet portion and an impeller portion thereof for cleaning said jet pump and an access opening formed in the upper portion of said hull to the rear of said cover for accessing said removable jet pump unit portion for cleaning of said jet pump from above.

23. A watercraft as set forth in claim 22, wherein the access area for the removable portion of the jet pump unit is formed under a removable storage compartment.

24. A watercraft as set forth in claim 23, wherein the access opening is comprised of a funnel-shaped portion and the removable portion of the jet pump unit housing is surrounding by a cylindrical projection and a flexible conduit either connecting said funnel-shaped portion and said cylindrical portion.

25. A watercraft comprised of a hull having a forwardly tapering bow in top plan view with a substantially wider rear hull area, a passengers' area formed in the upper area of said hull comprising a first portion extending transversely thereacross, and containing a bench-type seat sized to accommodate at least three adult passengers seated in side-by-side fashion, said passengers' area further comprising a second, forward portion formed at the bow of said hull, a pass-through portion formed in said hull by a pair of inwardly extending portions that extend into the passenger's area from the sides of said hull for connecting said first and said second passenger area portions with a common floor extending therebetween for passage between said second portion and said first portion, said pass-through area being no greater than substantially the same width as one of the seats, one of said inwardly extending hull portions being disposed forwardly of one side of said bench type seat and supporting a steering control for said watercraft, and the other of said inwardly extending hull portions forming a backrest for a single seat provided in one portion of said passengers' area.

26. A watercraft as set forth in claim 25, wherein the forward passengers passengers' area tapers toward a line terminating at the peripheral edge of said hull.

27. A watercraft as set forth in claim 26, further including a storage area formed in the forward passenger's area at the peripheral edge of the hull.

28. A watercraft as set forth in claim 27, wherein the storage area is formed beneath a raised portion in the floor of the hull so that the raised portion forms a further seat for a passenger facing rearwardly.

29. A watercraft comprised of a hull defining a passengers' area in an upper portion thereof, at least one seat formed in said passengers' area at a peripheral portion thereof, said seat comprising a bottom portion adapted to support a seated rider and a seat back portion, said backrest portion being formed with a first vertically extending part against which a seated rider may place his back, and a connected horizontally extending part forming at least in part an upper surface of said hull, and means for pivotally connecting said horizontally extending part of said seat back portion to the remainder of said hull for pivoting said seat back portion to an opened position for exposing an internal area of said hull.

30. A watercraft as set forth in claim 29, further including a propulsion unit for the watercraft disposed to the rear of the passenger's area, said propulsion unit comprising an internal combustion engine and a propulsion device driven by said engine.

31. A watercraft as set forth in claim 30, wherein the propulsion device comprises a jet pump.

32. A watercraft as set forth in claim 31, wherein there are provided a pair of propulsion devices behind the passenger's compartment for propelling the watercraft.

33. A watercraft as set forth in claim 31, further including a removable portion in an upper portion of the jet pump for accessing a water inlet portion and an impeller portion thereof for cleaning said jet pump and an access opening formed in the upper portion of the hull to the rear of the cover for accessing the removable jet pump unit portion for cleaning of the jet pump unit from above.

34. A watercraft as set forth in claim 33, wherein the access area for the removable portion of the jet pump unit is formed under a removable storage compartment.

35. A watercraft as set forth in claim 33, wherein the access opening is comprised of a funnel-shaped portion and the removable portion of the jet pump unit housing is surrounding by a cylindrical projection and a flexible conduit either connecting said funnel-shaped portion and said cylindrical portion.

36. A watercraft claim 31, wherein there are provided a pair of propulsion devices behind the passenger's compartment for propelling the watercraft each having a clean out device.

37. A watercraft comprised of a hull defining an undersurface at least in part containing a jet propulsion unit, said hull having an upper deck portion extending across the upper peripheral portion of said jet propulsion unit, said jet propulsion unit having a clean-out opening formed in an upper portion thereof, an access opening formed in said hull deck portion in aligned relationship with said jet propulsion unit clean-out portion, and a flexible conduit interconnecting said hull opening and said jet propulsion unit clean-out portion.

* * * * *